United States Patent [19]

Lothmann

[11] Patent Number: 4,905,755

[45] Date of Patent: Mar. 6, 1990

[54] METHOD OF AND APPARATUS FOR AUTOMATICALLY FILLING A CONTINUOUS CASTING MOLD

[75] Inventor: Josef Lothmann, Langerwehe, Fed. Rep. of Germany

[73] Assignee: Zimmerman & Jansen GmbH, Duren, Fed. Rep. of Germany

[21] Appl. No.: 210,032

[22] Filed: Jun. 22, 1988

[30] Foreign Application Priority Data

Jun. 22, 1987 [DE] Fed. Rep. of Germany ..... 3720586
Nov. 12, 1987 [DE] Fed. Rep. of Germany ..... 3738489

[51] Int. Cl.[4] ..... B22D 11/18

[52] U.S. Cl. ..... 164/453; 164/449; 164/437; 164/488; 222/602

[58] Field of Search ..... 164/453, 449, 133, 488, 164/337, 437; 222/590, 602

[56] References Cited

U.S. PATENT DOCUMENTS 4,271,896 6/1981 Becus ..... 164/453
4,473,104 9/1984 Ungarean et al. ..... 164/453
4,739,908 4/1988 Stangl ..... 164/337

FOREIGN PATENT DOCUMENTS 1945276 9/1969 Fed. Rep. of Germany .
1935782 1/1971 Fed. Rep. of Germany .
2637548 2/1978 Fed. Rep. of Germany .
55-141366 11/1980 Japan ..... 164/453
58-53361 3/1983 Japan ..... 164/453
62-192246 8/1987 Japan ..... 164/453

*Primary Examiner*—Richard K. Seidel
*Attorney, Agent, or Firm*—Lorusso & Loud

[57] ABSTRACT

A method of and apparatus for automatically filling a continuous casting mold with (steel) melt which is poured in controlled fashion into the continuous casting mold through a bottom hold adapted to be closed by an automatically operated stopper in a distributor channel or intermediate vessel. The stopper carries out predetermined up and down movements, especially in response to the melt level in the continuous casting mold against the action of a force urging the stopper into closing position, while the mold is being filled. The up and down movement of the stopper is realized by an adjustment unit acting directly at the top end of the stopper. The force which urges the stopper into closing position is obtained either from a constant mass or an elastic member attempting to urge the stopper increasingly into closing position as the temperature rises. The elastic member preferably is embodied by closed gas pressure springs, while the adjustment unit preferably is constituted by open spring members corresponding, in structure, to the closed spring members.

37 Claims, 15 Drawing Sheets

METHOD OF AND APPARATUS FOR AUTOMATICALLY FILLING A CONTINUOUS CASTING MOLD

The instant invention relates to a method of automatically filling a continuous casting mold and to apparatus for carrying out the same.

In principle, continuous casting plants operate according to the same basic mechanical concept. They consist of a revolving ladle turret or ladle barrow, a distributor channel truck, molds with mold lift drive means, casting machine (continuous casting drive means), cold bar means, roller beds for discharge, divider means for severing bars, transverse hauling equipment and other means for handling cast material, especially steel. A process guidance system for continuous casting plants must comprise all the means of automation required for optimum process flow. The measuring and control means comprise two part systems, namely drive control and control of the process engineering. One part of the system is the control of the casting level which may be coordinated with the drive control because of its interfaces and structure. It is the function of casting level control to keep the steel level in the mold constant at a preselectable height during the pouring process. Deviation from the preselected casting level is achieved by varying the rate of flow of steel from the distributor channel or intermediate vessel into the mold, by varying the speed of withdrawal, or by a combination of both. The accuracy obtainable in the casting level control depends essentially on the format cast, the speed of withdrawal, the adjustment characteristics, the stoppers and teeming nozzles used, and on interference factors inherent in the plant.

Electro-hydraulic adjustment drives of proportional adjusting character have become accepted as the stopper adjustment drive means. Such drive means are available with adjusting levers or with a separate adjusting cylinder. Where billets are produced, the first type prevails which requires mechanical transmission of the path of adjustment. In the case of plants producing slabs, the arrangement including the separate adjusting cylinder is preferred. The adjusting cylinder is attached directly to the parallel guide means of the stopper mechanics in order to keep the clearance at a minimum between mechanical transmission members.

In most instances, however, the quality of the stopper mechanics does not meet the high demands. And yet its quality is decisive for the proper functioning of the entire casting level control means.

With the stoppers and teeming nozzles in use, the stopper travels only a very short distance of but a few millimeters from the "closed" position to the position of "full flow rate". For this reason the position of the adjustment drive must be transmitted accurately and without clearance to the stopper so as to lay the ground for perfect functioning of the control means. An example of known stopper mechanics is presented in DE No.-B-23 19 004.

The significance of the instant invention is to be seen in the elimination of the stopper mechanics with the inherent clearance of mechanical transmission elements, whereby an extremely precise stopper movement and corresponding casting level control can be achieved. At the same time, a high degree of reliability is warranted since the stopper always is under the load of an elastic member which tends to urge the stopper increasingly into closing position in correspondence with the rise in temperature.

It is preferred to use one or more closed gas pressure springs according to DE No.-C-24 06 006 as the elastic member serving this purpose since they have proved very successful in the respective art.

Similarly, gas pressure springs may be used as the adjustment unit. However, they each are open, i.e. connected to a gas pressure source so that they may be moved against the action of the elastic member mentioned, with corresponding movement of the stopper.

It should be mentioned here that it is known from EP No.-B-32 442 to the stopper of an intermediate vessel in a copper or aluminum casting plant by means of an adjustment member acting directly at the head of the stopper in upward and downward directions against the action of a helical compression spring attempting to urge the stopper into closing position. The adjustment member comprises a housing with a diaphragm to which the upper end of the stopper rod is directly attached. In response to the level of the melt, more or less pressure medium is introduced into the housing, causing corresponding movement of the diaphragm or stopper rod.

The known arrangement is not suitable for plants in which steel is cast continuously since the temperatures are much higher. The known diaphragm-type adjustment member may be exposed to a maximum temperature of about 100° C. The same is true of the return spring embodied by a helical compression spring. At higher temperatures above all the effect of the helical compression spring would suffer considerably, the spring perhaps even becoming ineffective. The temperatures at the head of a Monobloc stopper in operation of a continuous steel casting plant are well above 1000° C. At these high temperatures a helical compression spring is unsuitable to cause the returning motion of the stopper.

The spring actually would "collapse" under load. The diaphragm of the known diaphragm-type adjustment member would react similarly so that the known structure, at best, is suitable for plants in which copper or aluminum are cast continuously.

The difficulty discussed above does not occur with the stopper actuating means according to DE No.-B-23 19 004 which likewise comprises a helical compression spring as the restoring member because in that case the helical compression spring is disposed next to the pouring ladle where the temperatures are much lower than just above the melt level or at the head of the stopper.

As already explained briefly above, especially the spring members according to DE No.-C-24 06 006 which have proved to be successful for many years in the ladle gate area are well suited for use as thermodynamic elements as they do not give up their operational reliability even under extreme temperature conditions.

If one makes use of the spring members mentioned, the direct control of the stopper rod according to the invention can be implemented without any difficulty. Thus the stopper rod can be moved up and down without any tolerance, being driven automatically in response to the level of the melt or casting level in the mold.

The system of the invention, at the same time, makes it possible to move the stopper up and down in oscillating fashion and/or to rotate it to and fro. The effect of the oscillating drive is not lost by any clearance of mechanical transmission members. The oscillating frequency preferably is from 2 to 20 Hz.

The oscillation of the stopper enhances the flow of the steel melt past the stopper out through the bottom hole in the distributor channel or intermediate vessel. It also contributes to reducing the formation of deposits at the lower end of the stopper, thereby considerably increasing the service life of the stopper. The stopper safeguards tight closing of the bottom hole even after a number of castings. In this respect the system according to the invention is especially well suited for the so-called sequential casting. The proposed oscillation of the stopper is claimed also independently of the other features of the system of the invention. It is merely that it can be realized particularly advantageously or effectively within the limits of the system according to the invention.

The rotational oscillation or oscillation of the stopper about its own longitudinal axis is especially advantageous with the most recently offered Tundish Rotary Valve to warrant easy movement of the rotational stopper with respect to the bottom hole serving as thrust bearing. Moreover, the structure according to the invention (elastic member/adjustment unit) and the arrangement thereof at the stopper head likewise is suitable for the Tundish Rotary Valve. In this manner the rotational stopper may be relieved of any pressure prior to any adjusting movement so that it can be turned more easily into the desired angular position. This provides for a minimum initial break-away torque before each adjusting movement. In this manner precise, quick-reaction adjusting movements of the rotational stopper can be obtained.

It should also be observed here that the design of one embodiment of the present invention is characterized by a particularly low structural height. Another embodiment provides an apparatus without a transom or traverse that is movable vertically up and down for the stopper. In principle, it is conceivable as well to render the elastic member variable. However, in that event the initially demanded reliability of the arrangement is no longer guaranteed, that the stopper is moved immediately into closing position at maximum return force when the adjustment unit is pressureless.

Another embodiment of the present invention provides an apparatus in which the stopper closing member is embodied simply by a mass which positively urges the stopper into closing position when a certain adjusting or stopper lifting pressure is failed to be reached at the stopper adjustment members. This stopper closing mass is insensitive to temperature. It allows a compact structure of the drive head if the support of the stopper adjustment members at the stopper closing mass is accomplished inside vertical bores formed in the stopper closing mass.

In case of the design of the stopper closing members as spring members, it is advantageous to keep them at the lowest possible temperature.

Furthermore, it should be noted here that the principle according to which the stopper movement is effected exclusively by the stopper drive head designed according to the invention, in other words without the vertically moved transom or traverse, is claimed as an independent inventive concept. In spite of the rather big stroke length which the drive head must cover, to achieve this, the present invention still provides a compact, sturdy structure thereof. When using purely mechanical spring members as stopper closing members, care must be taken that they are high temperature resistant, i.e. that they must not lose their rigidity even at higher temperatures or temperatures up to 1,100° C. Practically, only Belleville springs are suitable rather than helical compression springs which actually "collapse" at such temperatures.

The invention will be described further, by way of example, with reference to the accompanying drawings, in which.

Figure 1:
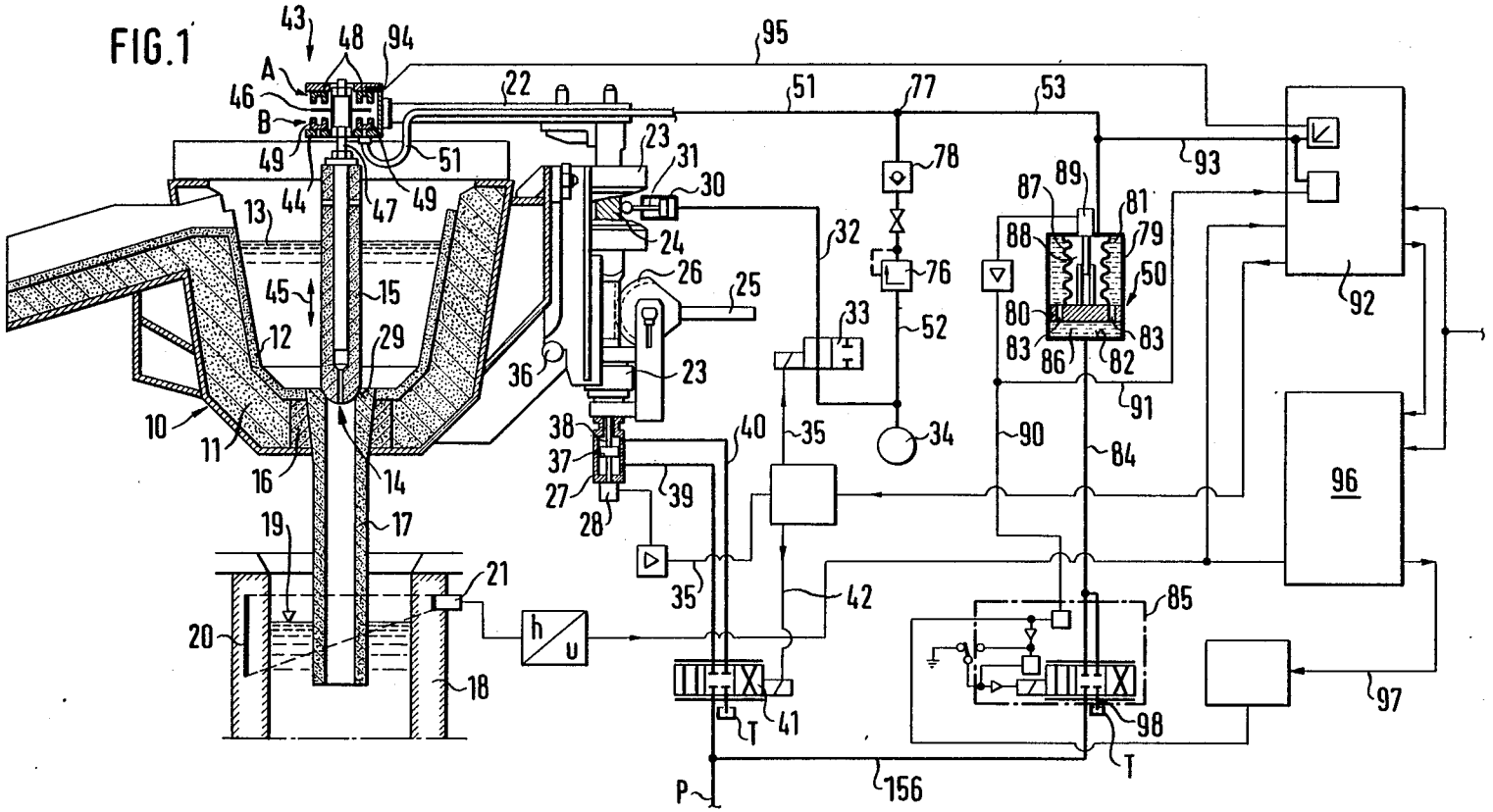
FIG. 1 is a diagrammatic sectional elevation of an apparatus according to the invention, including the corresponding control elements.

According to the embodiment shown in FIG. 1 there is provided a distributor channel 10 with refractory lining 11 and a protective layer 12 containing liquid metal, e.g. a steel melt 13. The distributor channel 10 has a bottom hole 14 and a monobloc stopper 15 for the bottom hole 14. The bottom hole 14 is defined by a teeming nozzle 16 and an ingate 17 which extends into a mold 18.

The system is furnished with casting level control in order to be able to change the flow of steel melt from the distributor channel 10 into the mold 18 such that the casting level 19 of the melt always will remain approximately at the same height. The control consists of a measuring means for the casting level 19 in the mold 18 and is formed by a radioactive radiation rod 20 and a scintillation counter 21 as the receiver, positioned opposite each other.

The stopper 15 is arranged for up and down movement or so as to be raised and lowered at the free end of a transom or traverse 22. The traverse 22 is connected to a rod 24 which is vertically displaceable in a guide member 23 fixed to the distributor channel 10. Vertical displacement of the rod 24 either is effected manually by means of a manually operated (hand lever 25) gear segment 26 meshing with corresponding teeth formed at the rod 24 or by means of an hydraulically actuated step adjustment cylinder 27 with an associated displacement pickup 28.

Vertical displacement of the rod 24 determines the zero position of the stopper 15 which position corresponds to the closing position of the stopper 15 when the adjustment unit B, to be explained in greater detail below, for the stopper 15 is pressureless prior to introducing steel melt 13 into the distributor channel 10. When in zero position, the stopper 15 is held under predetermined pressure (permanent preliminary pressure according to FIG. 4) abutting the edge 29 of the bottom opening 14.

A locking means 30 keeps the rod 24 in the zero position described, during the further operation. The locking means is a pneumatically operated piston and cylinder unit having a piston rod 31 which extends to the outside and is adapted to be pressed laterally against the traverse 22 which carries the rod 24, thus arresting the same. The locking means 30 is adapted to be connected through a pressurized air conduit 32 and a reversing switch 33 to an air pressure source 34 in which a pressure of approximately 6 bar prevails. A single connection 35 exists between the reversing switch 33 and the displacement pickup 28 associated with the step adjustment cylinder 27 so that, as soon as the stopper 15 has reached the given zero position, the reversing switch 33 is moved into a position in which the locking means 30 is in fluid communication with the air pressure source 34 whereby the piston of the locking means 30 is pressurized, locking the rod 24 accordingly.

The rod guide member 23, together with the traverse 22 and the stopper 15, is arranged for pivoting about a horizontal shaft 36 so that the stopper 15 may be swung out of the distributor channel 10 for purposes of repair or replacement.

The step adjustment cylinder 27 comprises a piston 37 adapted to be pressurized from both ends and including a piston rod 38 which extends to the outside and is connected to the vertically movable rod 24. The two cylinder chambers of the step adjustment cylinder 27 are adapted to be connected selectively through hydraulic conduits 39, 40 and a ¾ way valve 41 either to a pump P, a tank T, or neither to the pump P nor to the tank T (cf. FIG. 1). The ¾ way valve is solenoid controlled, the control signal being given through signal connections 35, 42 in dependance on the displacement pickup 28 associated with the step adjustment cylinder 27.

The nucleus of the apparatus described is a thermodynamic precision drive head 43 arranged between the traverse 22 and the stopper 15 and comprising a stopper closing member A which increasingly urges the stopper 15 into closing position as the temperature rises and a pneumatically operable adjustment unit B which is effective against the action of the closing member A. Both the stopper closing member A and the adjustment unit B are disposed inside a frame or housing 44 connected to the traverse 22. They are positioned on top of each other, the thermodynamic closing member A being located above the thermodynamic unit B. Between members A and B there is a flange 46 which is movable with respect to the housing 44 in the direction of the up and down movement (double arrow 45) of the stopper 15, the stopper 15 or rather the stopper rod 47 being connected to this flange.

The thermodynamic closing member A thus is supported at the top on housing 44, on the one hand, and at the bottom on carrier flange 46, on the other hand, while the thermodynamic adjustment unit B disposed underneath the same is supported at the top at carrier flange 46 on the one hand, and at the bottom on housing 44, on the other hand.

The thermodynamic closing member A comprises a plurality of spring members 48 arranged circumferencially and each being of the type of closed gas pressure springs according to DE No.-C-24 06 006. The thermodynamic adjustment unit B comprises the same or a different number of uniformally spaced open spring members 49 of the kind in question likewise arranged circumferencially. The latter are connected to a gas pressure source, namely air pressure source 34 and to a pressure generator 50 to be described in greater detail below, the connection being established through a compressed air conduit 51, 52 and 51, 53, respectively. The spring members 48, 49 and their arrangement inside the housing 44 as well as their association to the carrier flange 46 will now be described in greater detail with reference to FIG. 2.

Both the closed spring members 48 and the open spring members 49 are supported, on the one hand, on the transversely split housing 44 and, on the other hand, on the flange 46 which is disposed in between and to which the stopper 15 or rather its stopper rod 47 is secured (threaded nuts 54). The carrier flange 46, together with the stopper rod 47 and the stopper 15, is arranged inside the housing 44 for relative movement in the longitudinal direction of the stopper 15. This path of movement or travelling distance is limited at one end by the closed spring members 48 and at the other end by the open spring members 49. The frame or housing 44 is split in transverse direction for disassembly of the spring members 48, 49. The divisional plane is marked by reference numeral 55 in FIG. 2.

The spring members 48, 49 all have the same structure, except that the spring members 49 defining the adjustment unit B include an open compressed air chamber, as will be explained in greater detail below. Furthermore, the spring members 48, 49 each include a tubular shell 56 closed at the front end to form a cylindrical chamber. A free standing piston 57 is located in the interior of each spring member. Forming an annular collar, it is offset at a free end 59 of smaller diameter including a support surface 58. This free end is guided axially in a bore 60 of the corresponding front-end closure 61 of the tubular shell 56. The piston is sealed by the fact that the central range of the front-end closure 61 is connected tightly and firmly to one end of a metal bellows 62 the other end of which is connected to the piston 57 in the same pressure-resistant and gas tight manner. In the case of the closed embodiment, namely with the spring members 48 the space between the tubular shell 56 and the metal bellows 62 as well as the piston 57 and the upper front-end closure 65 has been filled with a pressurized inert gas through a filling opening 64 now closed by a plug 63, this pressure acting on the piston and pressing the free end 59 of piston 57 until engagement is established between the collar 66 and the bore 60.

In the case of the open design of the spring member described above, namely the lower spring members 49 in FIG. 2, the filling opening 64 it provided with a connection 67 to the compressed air conduit 51 already mentioned.

Figure 2:
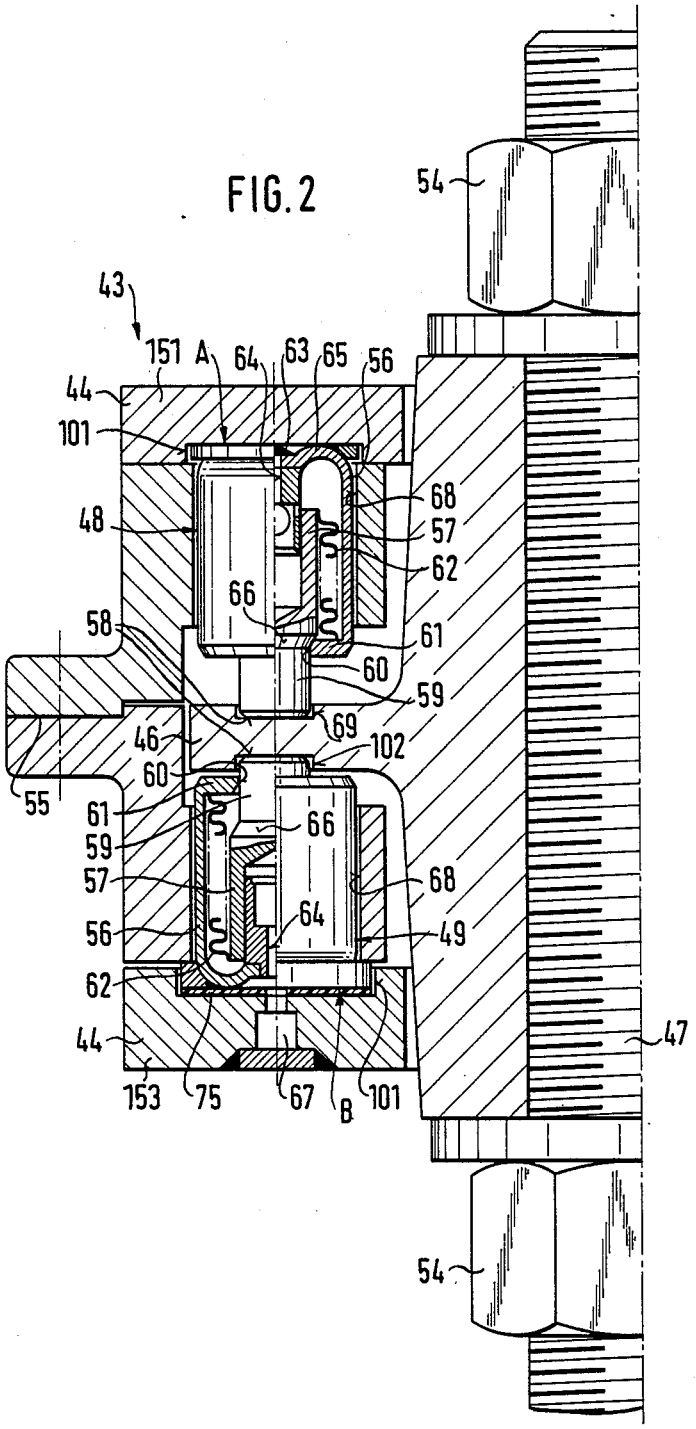
FIG. 2 is a sectional elevation of part of the apparatus according to the invention, on an enlarged scale.

The spring members 48, 49 each are positioned inside receiving bores 68. The positioning with respect to the carrier flange 46 is accomplished by annular recesses 69, 102 which are disposed at the carrier flange 46 and into which protrude the free ends 59 of the spring members 48, 49. As shown in FIG. 2, the spring members 48, 49 are mounted such that their free ends 59 act on the carrier flange 46 in mutually facing relation.

The gas pressure in the interior of the upper closed spring members 48, and thus the contact pressure developed by the same, rises to the operational value under the influence of the heat transmitted from the steel melt in the distributor channel 10. It is not necessary to cool the spring members 48 or to take special structural measures in order to protect them from high temperatures. They are assembled in relieved condition. The full contact pressure of the spring members 48 develops in operation, and it may rise still further as the temperature rises since it is based exclusively on the equations of ideal gases. In corresponding manner, the stopper 15 is pressed into closing position when the spring members 49 are pressureless, as shown quite clearly in FIG. 4.

Figure 4:
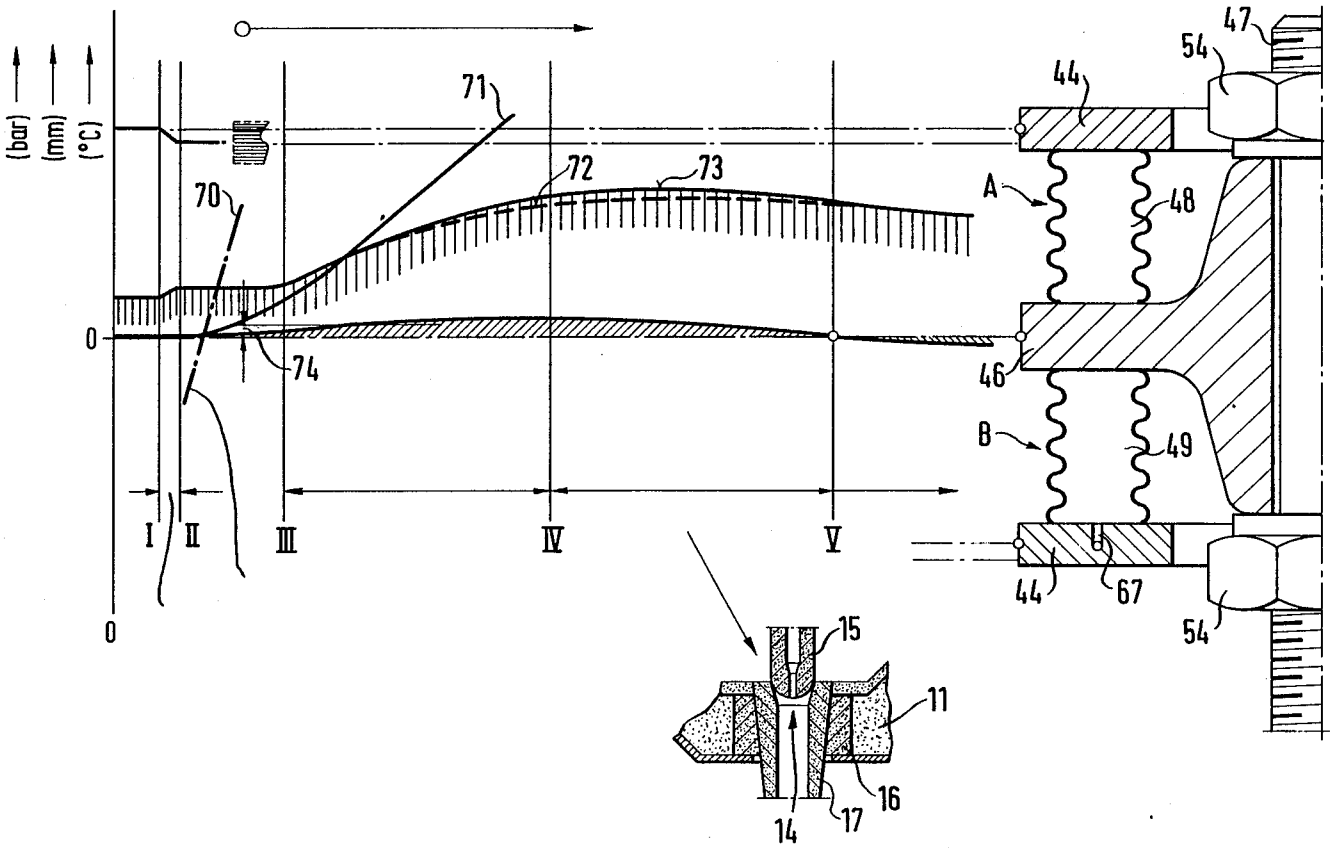
FIG. 4 is a pressure, path, and temperature diagram of the temperature-responsive return member associated with the stopper.

The stopper 15 is pressed against the edge 29 of the bottom hole 14 under predetermined contact pressure or preliminary pressure by means of the step adjustment cylinder 27 or the manual adjusting means 25, 26 when the locking means 30 is released. This defines the so-called zero position of the stopper 15. This means that position II in FIG. 4 is reached. Subsequently liquid steel in the form of melt 13 is introduced into the distributor channel 10 (cf. dash-dot line 70 in FIG. 4), causing a corresponding rise in temperature in the range of the thermodynamic precision drive head 43 (cf. temperature line 71 in FIG. 4). As a result of this temperature increase the closed spring members 48 expand, whereby the contact pressure of the stopper 15 is increased accordingly. The increase of this contact pressure is shown in FIG. 4 by a corresponding pressure rise in the closed spring members 48 (cf. pressure line 72). Further pressure increase takes place as a result of the unavoidable longitudinal expansion of stopper 15, it is shown in FIG. 4 by pressure line 73.

After a certain time of operation a reduction in pressure and a corresponding lowering of the contact pressure of stopper 15 results by the drive force 74 of the stopper and the unavoidable wear of the sealing range.

FIG. 4 is a good illustration of the degree of safety and reliability offered by the closed spring members 48 in case of failure of the stopper control through the open spring members 49. The closed spring members 48 tend to move the stopper 15 increasingly into closing position in correspondence with the rising ambient temperature.

The closed spring members 48, moreover, have the advantage of permitting softer pressing of the stopper 15 into the sealing zone during manual operation by lever 25 because dampening is guaranteed by the spring members 48.

The stopper 15 then is moved up and down exclusively by corresponding pressurization of the open spring members 49, with the locking means 30 fixed in position. The up and down movement of the piston 15 each takes place against the action of the closed spring members 48.

The open spring members 49 either may be controllable in common or individually, i.e. in different numbers, depending on the given operating conditions and design parameters. At the end of the open spring members 49 facing the compressed air connection 67 a seal 75 is disposed between the spring members and the housing 44 so as to warrant leakproof pressurization of the open spring members 49.

As explained above, the compressed air conduit 51 leading to the open spring members 49 which define the stopper adjustment unit B, on the one hand, communicates with a constant pressure air source 34 (branch line 52) and, on the other hand, with a pressure generator (branch line 53). The pressure air source 34, preferably kept under a pressure of approximately 6 bar, takes care of the compressed air supply of the open spring members 49. The basic pressure mentioned of approximately 6 bar is warranted by a pressure relief valve 76 disposed in branch line 52. A check valve 78 is arranged between the pressure relief valve and the connection 77 of line 52 to the compressed air conduit 51. This valve opens only in the direction from the pressure air source 34 to the open spring members 49.

The pressure air source 34 also feeds the locking means 30 described above.

In the embodiment shown in FIG. 1 the pressure generator 50 is of special design. It comprises a closed cylinder 79 and a piston 80 which is movable back and forth inside the cylinder and divides the cylinder 79 into two cylinder chambers 81, 82. These two cylinder chambers 81, 82 are in fluid communication with each other through fluid passages 83 provided in the piston.

The lower cylinder chamber 82 in FIG. 1 is provided with a connection to an hydraulic conduit 84 which connects the cylinder chamber 82 to a pressure proportional valve 85 of conventional structure. The pressure of the hydraulic fluid 86 in cylinder 79 can be controlled quickly and accurately by means of this pressure proportional valve 85. As the pressure proportional valve 85 is of conventional design, it need not be described in any greater detail here.

The cylinder chamber 81 is defined by the wall of the cylinder 79 and the piston 80, on the one hand, and by a centrally disposed metal bellows 87, on the other hand. In the embodiment shown, the metal bellows 87 is arranged coaxially within the cylinder 79 and connected tightly and firmly to the piston 80, on the one hand, and the opposite end wall of the cylinder 79, on the other hand. The space 88 enclosed by the metal bellows 87 is connected through line 53 to compressed air conduit 51. Thus the hydraulic pressure given by the pressure proportional valve 85 is transmitted directly in the pressure generator 50 to the gas-end or air-end drive portion.

It is conceivable to replace the pressure proportional control of the hydraulic end by volume flow control. However, in this case, too, the pressure generator 50 is to be designed as a hydro-pneumatic transforming unit.

Likewise associated with the piston 80 is a displacement pickup 89 furnishing signals which, on the one hand, serve as feedback and control signals (signal line 90) for the pressure proportional valve 85 and, on the other hand, as check signals (signal line 91) for determining leaks at the gas-end drive portion. In the latter case the signals of the displacement pickup 89 are applied by way of signal line 91 to a signal processor 92.

The signals of the displacement pickup 89 correspond to a pressure which is predetermined by the pressure proportional valve 85. This pressure should prevail also in the compressed air conduit 51 leading to the open spring members 49. The air pressure in the compressed air conduit 51 leading to the open spring members 49 is tapped by a pressure signal line 93. The signal processor 92 then compares the desired pressure values with the actual pressure values. If the result shows that the actual pressure is much lower than the rated pressure, it must be assumed that there is an inadmissible leak at the pressure air-end of the system.

The provision of one or more thermocouples 94 in the area of the closed spring members 48 is of great significance for motion control of the stopper 15. The temperatures they measure permit the calculation of the pressure exerted by the closed spring members 48 in closing direction of the stopper 15. It is against this pressure that the stopper movement is controlled, and the corresponding counterpressure must be build up in the open spring members 49 or the compressed air conduit 51 leading to the same. Therefore, a permanent comparison in the signal processor is needed between the calculated closing pressure of the closed spring members 48 and the adjustment pressure in the open spring members or the compressed air conduit 51 leading to the same. The temperature values of the thermocouple 94 are applied through a signal line 95 to the signal processor 92 where they are processed in the manner described above.

The signal processor 92 further is fed with the actual and rated values of the melt level. This is accomplished through the intermission of a process controller 96 which, finally, also sets the adjustment magnitude 97 for the pressure proportional valve 85.

The pressure proportional valve 85 is connected to the pump P through an hydraulic conduit 156 and to the tank T through hydraulic conduit 98.

It should be mentioned also that all thermodynamic members 48, 49 are checked without any manual intervention and without removing them from the drive head 43. The signal processor 92 is suitable for automatically checking the accurate functioning of all thermodynamic members 48, 49 when the distributor channel is in waiting position or before each new sequence casting. At the same time, an OK message is given of the entire control and regulating circuit. If not, a corresponding message of disturbance is given.

A characteristic of any stopper control (as against slide-type closures) is the extremely high control gain factor. This high gain factor is damped elegantly in accordance with the instant invention by the provision of the transforming pressure generator 50 which, at the same time, separates the oil hydraulic pressure setting control from the gas-end or pressure air-end drive portion.

Figure 3:
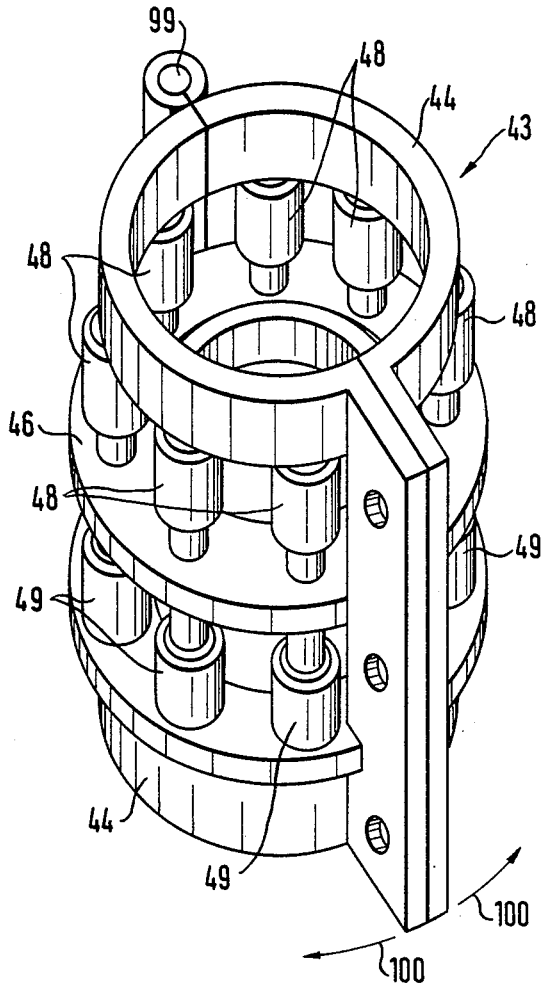
FIG. 3 is a perspective view of a detail modified as compared to FIG. 2 of the apparatus according to the invention.

FIG. 3 shows a modified embodiment of the drive head 43 in which all those parts already described are marked by the same reference numerals. The drive head 43 according to FIG. 3 differs from the one shown in FIGS. 1 and 2 in that the frame or housing 44 is divided longitudinally. It may be swung open (arrows 100) in the manner of a hinge (hinge axis 99), exposing the stopper rod 47 which is not shown in FIG. 3.

Figure 5:
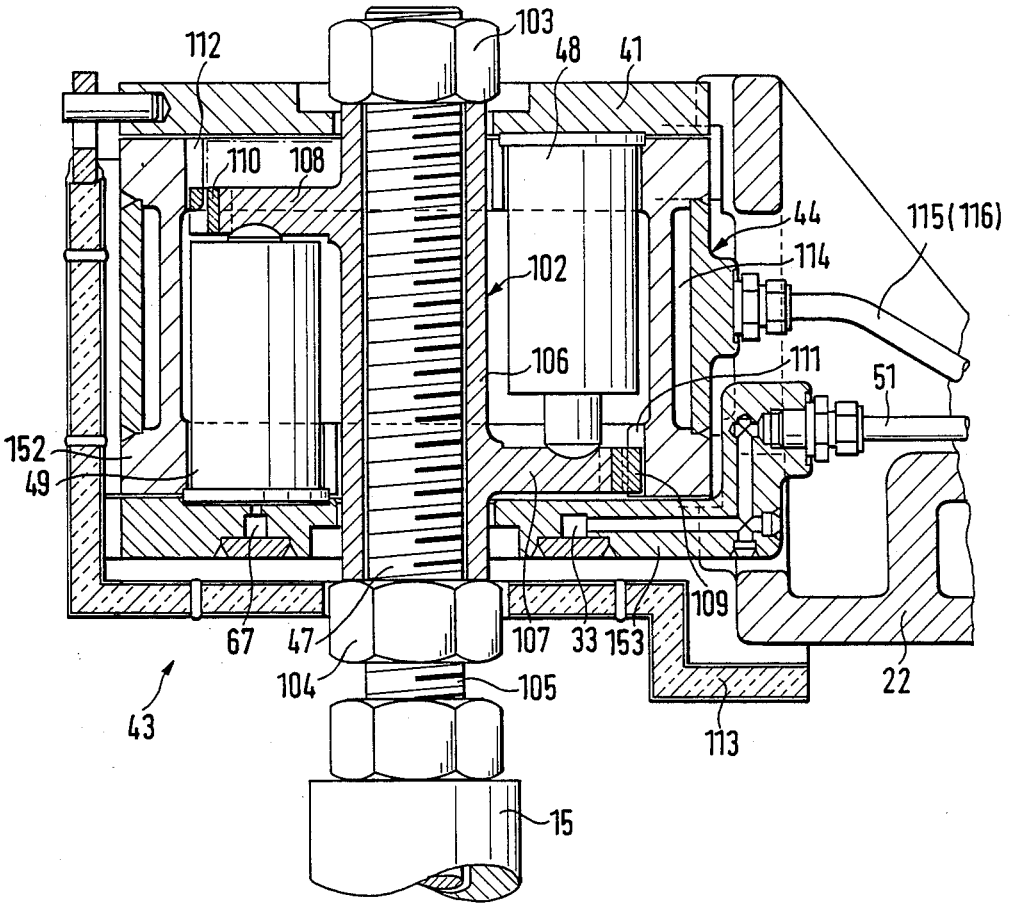
FIG. 5 is a sectional elevation of another embodiment of a drive head for the stopper according to FIG. 1, on an enlarged scale.
Figure 6:
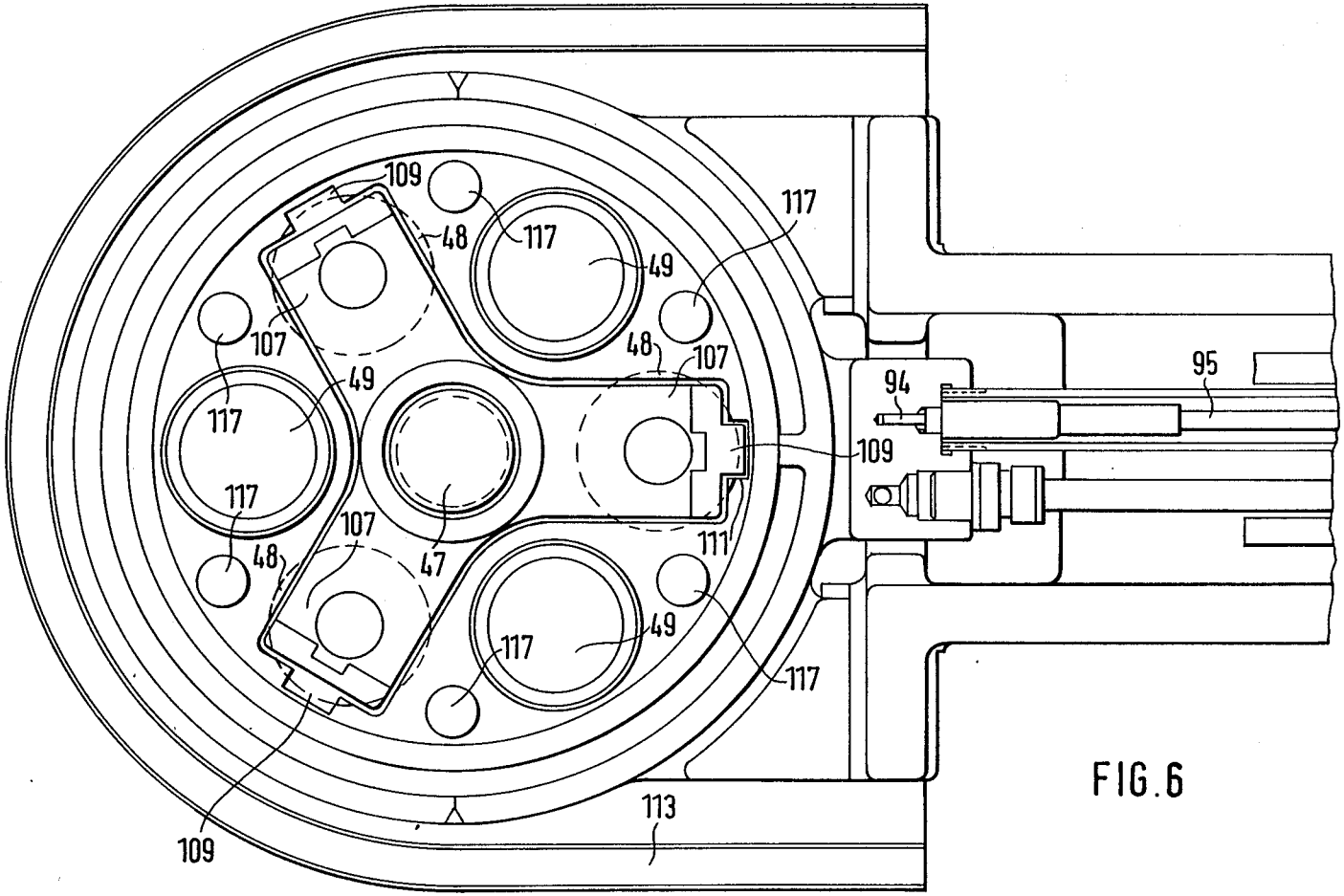
FIG. 6 shows the drive head according to FIG. 5 as seen from below, the lower cover and lower insulation having been omitted.
Figure 7:
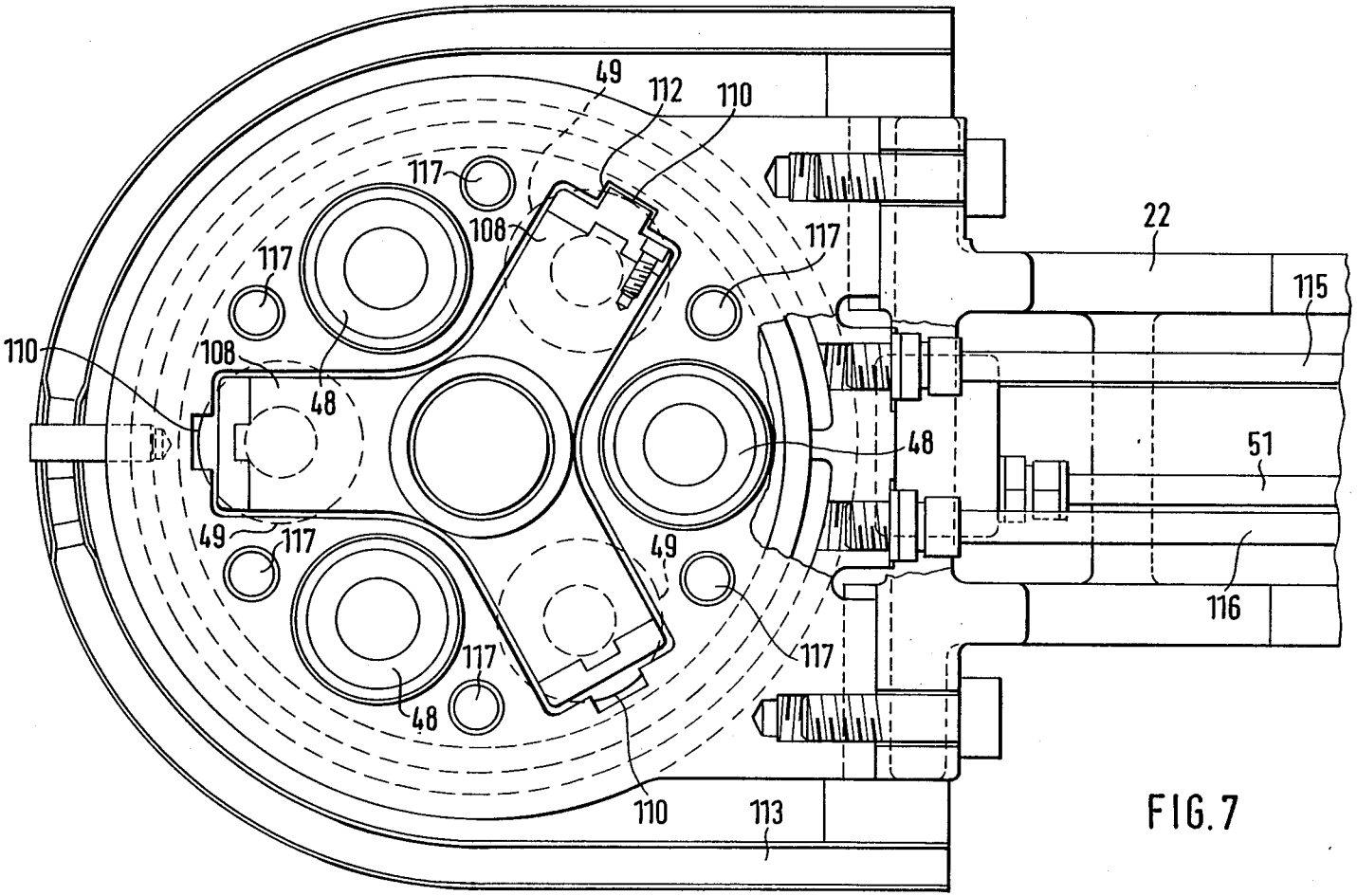
FIG. 7 shows the drive head according to FIG. 5 as seen from above, the upper cover having been omitted.

In the case of the embodiment of the stopper drive head 43 as shown in FIGS. 5 to 7 the stopper closing member A comprises three spring members 48 arranged in a plane perpendicular to the longitudinal axis of the stopper, around the same, at approximately the same spacing from one another. The spring members each may be of the type of closed gas pressure springs according to DE No.-C-24 06 006.

The stopper adjustment unit B comprises the same number of spring members 49 of the type mentioned, distributed uniformly along the circumference but being open, i.e. provided with a connection 67 to a pressure gas source. Communication between the connections 67 and the pressure gas source may be established in a manner as yet to be described through a compressed air conduit 51.

As shown in FIG. 5, the stopper drive head 43 comprises a housing ring 152 closed at its upper end face by a cover plate 151 and at its lower end face by a bottom plate 153. The stopper rod 47 extends through aligned central apertures in the bottom plate 153 and cover plate 151 and a support member 102 is fixed on the upper, free end of the rod between two fixing nuts 103 and 104 which are screwed on a threaded portion 105 at the free upper end of the stopper rod 47. The support member 102 consists of a central sleeve 106 and three support arms 107 arranged at the lower end thereof as well as three support arms 108 formed at the upper end and each extending in a plane perpendicular to the longitudinal axis of the stopper or sleeve and at the same angular spacing from each other. The upper and lower support arms are arranged staggered with respect to each other, as is quite evident from a comparison of FIGS. 6 and 7.

The stopper adjustment unit B in the form of pneumatically operated spring members 49 is arranged between the upper support arms 108, on the one hand, and the bottom plate 153 of the housing 44 of the drive head, on the other hand, whereas the spring members 48 are placed between the lower support arms 107 and the cover plate 151.

Accordingly, the stopper closing members 48 and the stopper adjusting members 49 are arranged in the frame or housing 44 of the drive head 43 in star shape and encased with respect to each other, the result being minimum structural height in spite of opposed directions of effect of the members in question. As explained above, the stopper adjusting members 49 are designed similar to the gas pressure springs 48 with the only exception that they include a connection 67 for communication with a pressure air source. Consequently they are adapted to be expanded axially in correspondence with the pressure applied, against the action of the closed gas pressure springs 48, causing corresponding axial movement of the stopper 15. Thus the stopper 15 is movable up and down in the direction of double arrow 45 in response to the pressure applied. The travelling distance at each end is limited by the closed spring members 48 and the open spring members 49, respectively. Axial guidance also is provided for the radially extending support arms 107, 108 within the frame or housing 44 of the drive head 43. To this end the support arms 107, 108 are formed at their front ends with an axially extending projection 109 and 110, respectively, protruding into corresponding axial grooves 111, 112 at the inside of the housing ring 152.

The circumferencial surface as well as the bottom of the frame or housing 44 of drive head 43 is protected by an insulating layer 113 against too much heat or too high a temperature.

A water jacket 114 is formed within the housing ring 152 and cooling water circulates through the same during operation. The cooling water is supplied, as shown in FIG. 5, through a cooling water conduit 115. The cooling water is discharged through a conduit 116. In this manner the stopper closing members and the stopper adjusting members are protected from overheating. This measure is of particular significance when Belleville springs are used as the stopper closing members, as will be explained in greater detail with reference to FIGS. 8 and 9.

The housing ring 152 and the cover plate 151 and the bottom plate 153 are held together by bolts, especially necked-down bolts 117 (cf. FIGS. 6 and 7).

Very important for motion control of the stopper 15 is the provision of one or more thermocouples 94 in the area of the closed spring members 48. The pressure exerted by the closed spring members 48 in closing direction of the stopper 15 can be calculated from the temperature they measure. It is against this pressure that the stopper movement is controlled, and the corresponding counter pressure must be build up in the open spring members 49 or in the compressed air conduit 51 leading to the same. The temperature values of the thermocouple 94 are applied through a signal line 95 to a signal processor 92 where they can be processed in a manner which will be described in greater detail below with reference to FIG. 10.

Figure 8:
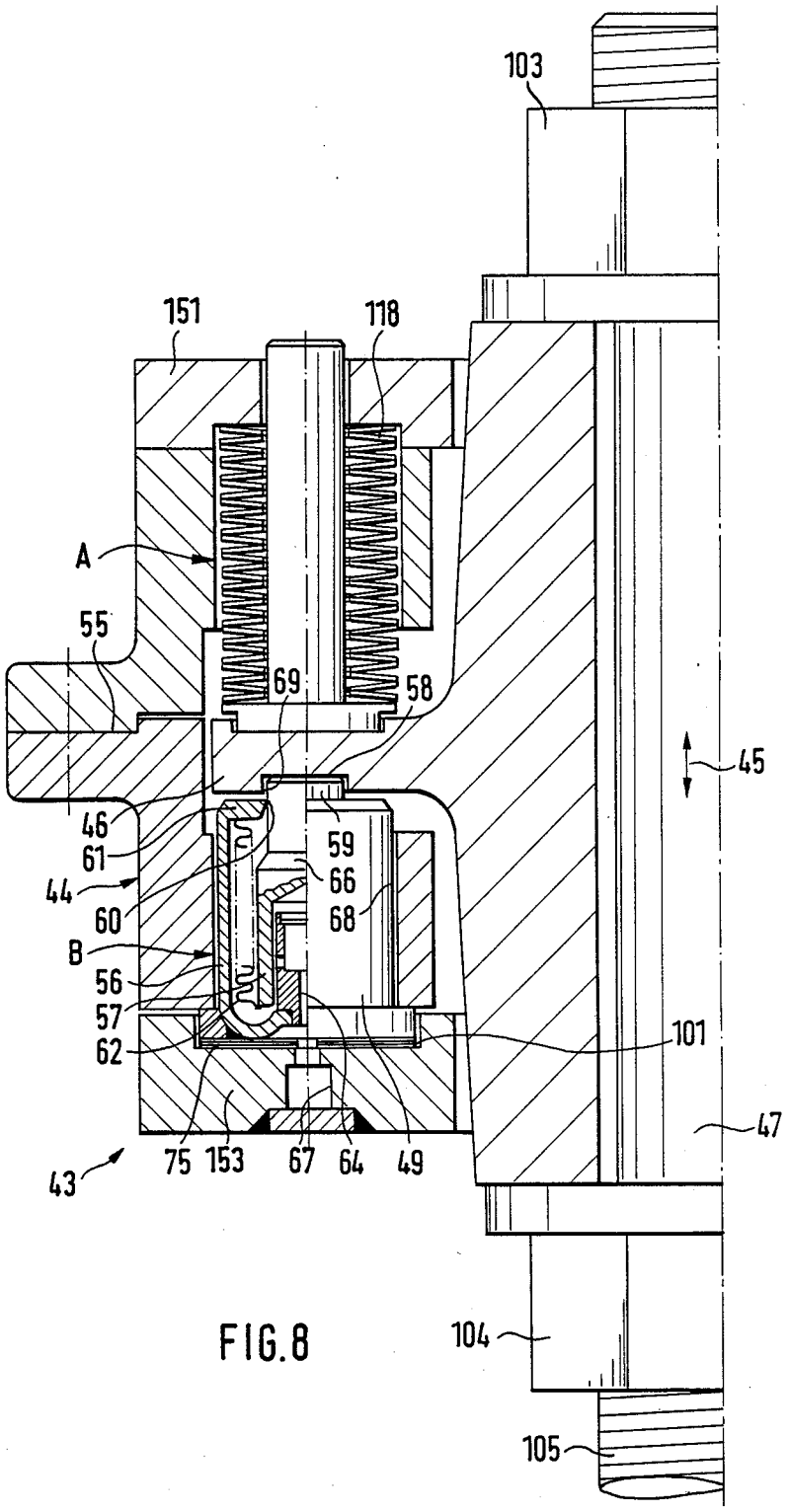
FIGS. 8 and 9 are sectional elevations of two further modified embodiments of a stopper drive head with Belleville springs serving as stopper closing members, on an enlarged scale.
Figure 9:
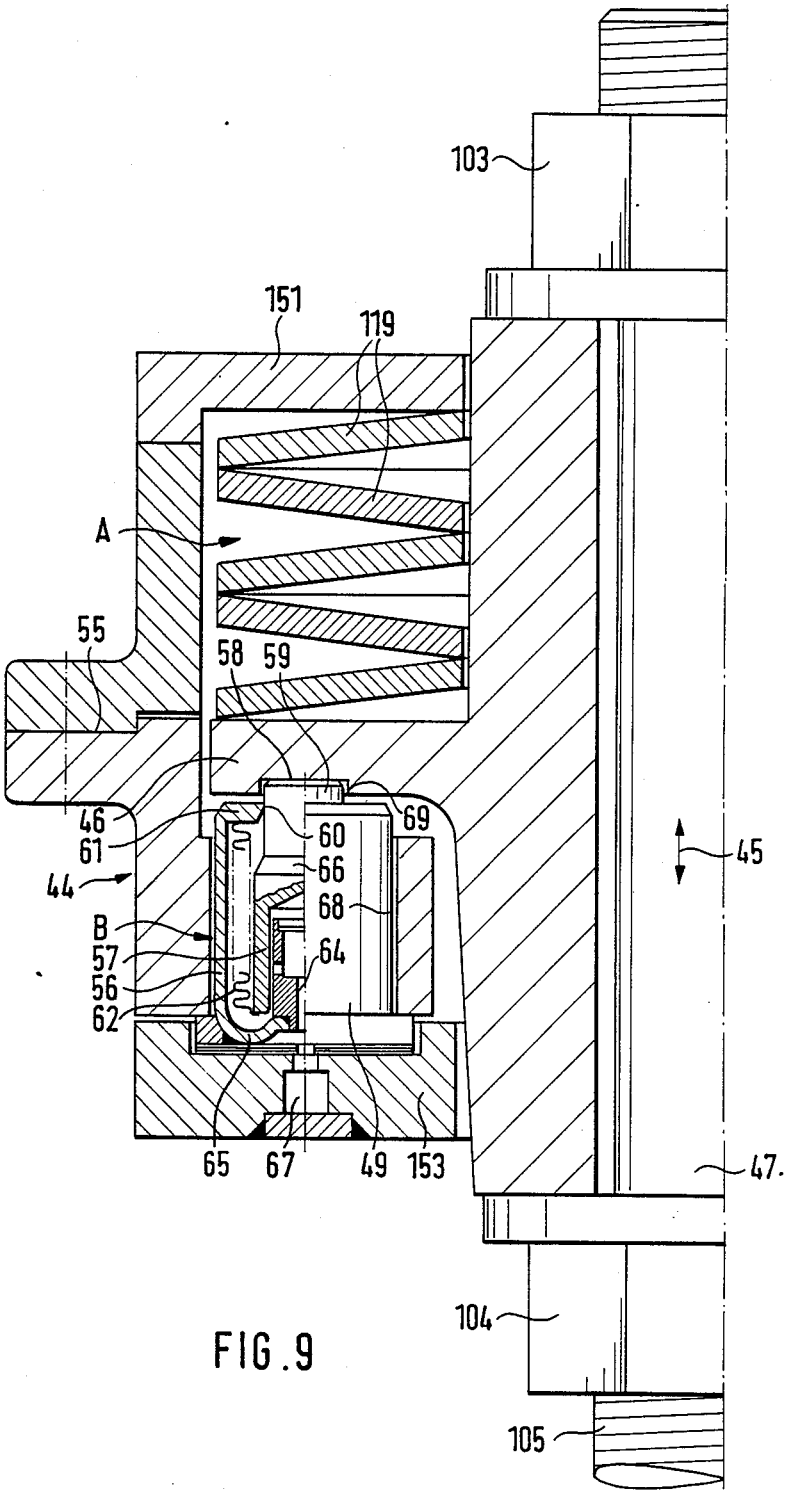

The embodiment shown in FIGS. 8 and 9 has members A and B disposed on top of each other within the frame or housing 44 of the stopper drive head 43 connected to the traverse 22. A movable flange 46 to which the stopper 15 or the stopper rod 47 is connected is disposed between members A and B and movable with respect to the frame or housing 44 in the direction of the up and down movement (double arrow 45) of the stopper 15 or stopper rod 47.

Member A thus is supported at the top at housing 44 or housing cover plate 151 and at the bottom at the carrier flange 46, on the other hand, while the stopper adjustment unit B positioned underneath is supported at the top at carrier flange 46 and at the bottom at the housing 44 or bottom plate 153 thereof.

In the case of the embodiment illustrated in FIG. 8 the stopper closing member A is constituted by a plurality of Belleville spring packages 118 equally spaced around the periphery, and in the case of the FIG. 9 embodiment by Belleville springs 119 extending across the entire circumference of carrier flange 46. Each are made of high temperature resistant spring steel so that their rigidity is substantially unvarying across the whole temperature range which prevails at the drive head 43.

The members 49 presenting stopper adjustment unit B each comprise a tubular shell 56 which is closed at the end to form a cylindrical chamber, as already explained above in connection with the embodiment shown in FIG. 2. A free standing piston 57 is provided in the interior of each member 49. The piston is formed with an annular collar and thus has a free end 59 of smaller diameter including a support face 58. This free end is guided axially in a bore 60 of the corresponding associated front-end closure 61 of the tubular shell 56. The piston is sealed by having the central area of the front-end closure 61 connected tightly and firmly to one end of the metal bellows 62 whose other end likewise is connected in pressure-resistant and gas-tight manner to the piston 57. In the case of the closed embodiment, namely of spring members 48 according to FIGS. 5 to 7, the space formed between the tubular shell 56 and the metal bellows 62 as well as the piston 57 and the front-end closure 65 has been filled through an opening 64 closed by a plug with a pressurized inert gas the pressure of which acts on the piston and presses the free end 59 of the piston 57 until engagement is established between the collar 66 and the bore 60. In the case of the open design shown in FIGS. 8 and 9, the filling opening 64 is provided with a connection 67 leading to the compressed air conduit 51 already mentioned.

The members 49 each are positioned inside receiving bores 68. They are positioned with respect to the carrier flange 46 by means of an annular recess 69 which is formed in the carrier flange 46 and into which protrude the free ends 59 of members 49.

The frame or housing 44 of the embodiment shown in FIGS. 8 and 9 is divided transversely and the transverse dividing plane is marked by reference numeral 55.

In a manner similar to support member 102 according to FIG. 5, the carrier flange 46 is fixed between two nuts 103 and 104 at the upper free end of the stopper rod 47. The nuts 103, 104 are adapted to be screwed on a threaded portion 105 of the stopper rod 47.

Another embodiment of a stopper control means will be described with reference to FIG. 10, the stopper stroke in this case being controlled exclusively by the adjusting members 49, on the one hand, and the closing members 48, on the other hand. In contrast to the embodiment shown in FIG. 1, therefore, the traverse carrying the stopper 15 is mounted vertically fixed at the distributor channel 10.

The compressed air conduit 51 leading to the open spring members 49 which constitute the stopper adjustment unit B communicates with a constant pressure air source 34 through a branch line 52, on the one hand, and with a pressure generator 50 through a branch line 53, on the other hand. The pressure air source 34 preferably kept at a pressure of approximately 6 bar, takes care of the compressed air supply of the open spring members 49, the basic pressure mentioned of approximately 6 bar being guaranteed by a pressure relief valve 76 connected in the branch line 52. A check valve 78 opening only in the direction from the pressure air source 34 to the open spring members 49 is arranged at the compressed air conduit 51 between the pressure relief valve and the connection 77 of line 52.

Figure 10:
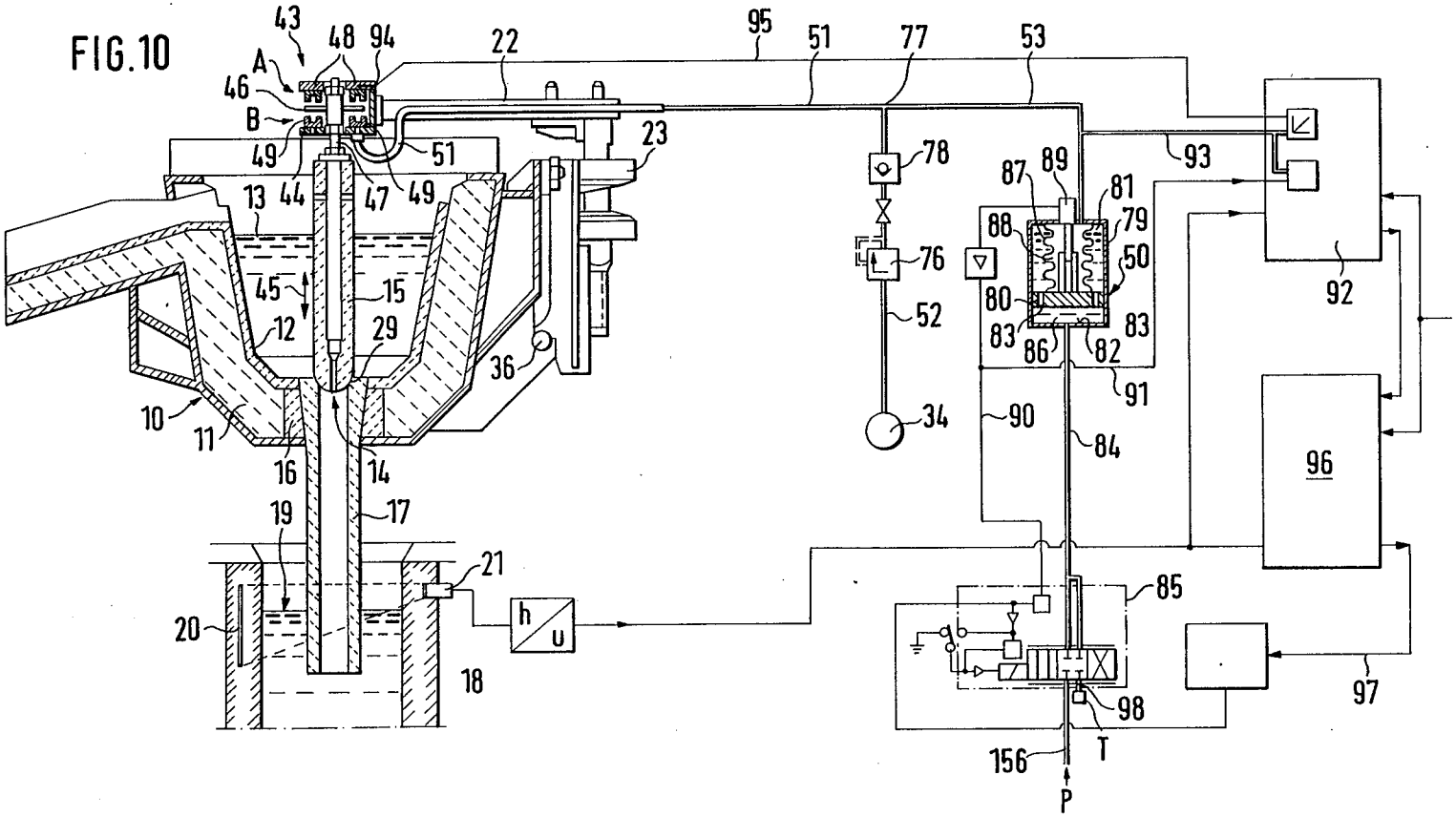
FIG. 10 is a diagrammatic sectional elevation of another embodiment of an apparatus according to the invention, including the corresponding control elements.

The structure of the pressure generator 50 of the embodiment shown in FIG. 10 is the same as described with reference to FIG. 1. As for the mode of operation in connection with the signal processor 92 and the thermocouples 94 we likewise refer to the corresponding description of FIG. 1.

Figure 11:
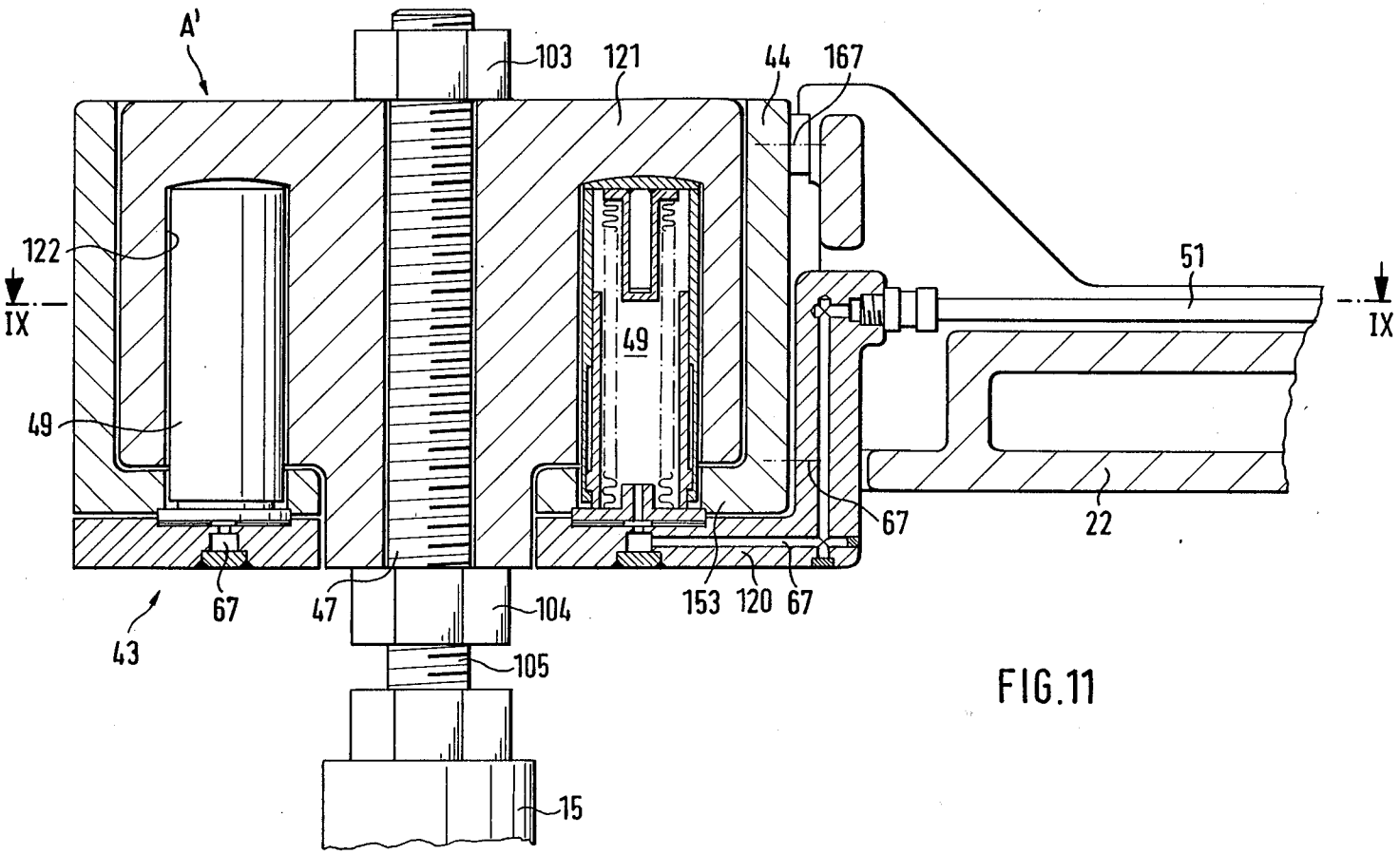
FIG. 11 is a sectional view along line VIII—VIII in FIG. 12 showing yet another modification of a stopper drive head designed according to the invention.
Figure 12:
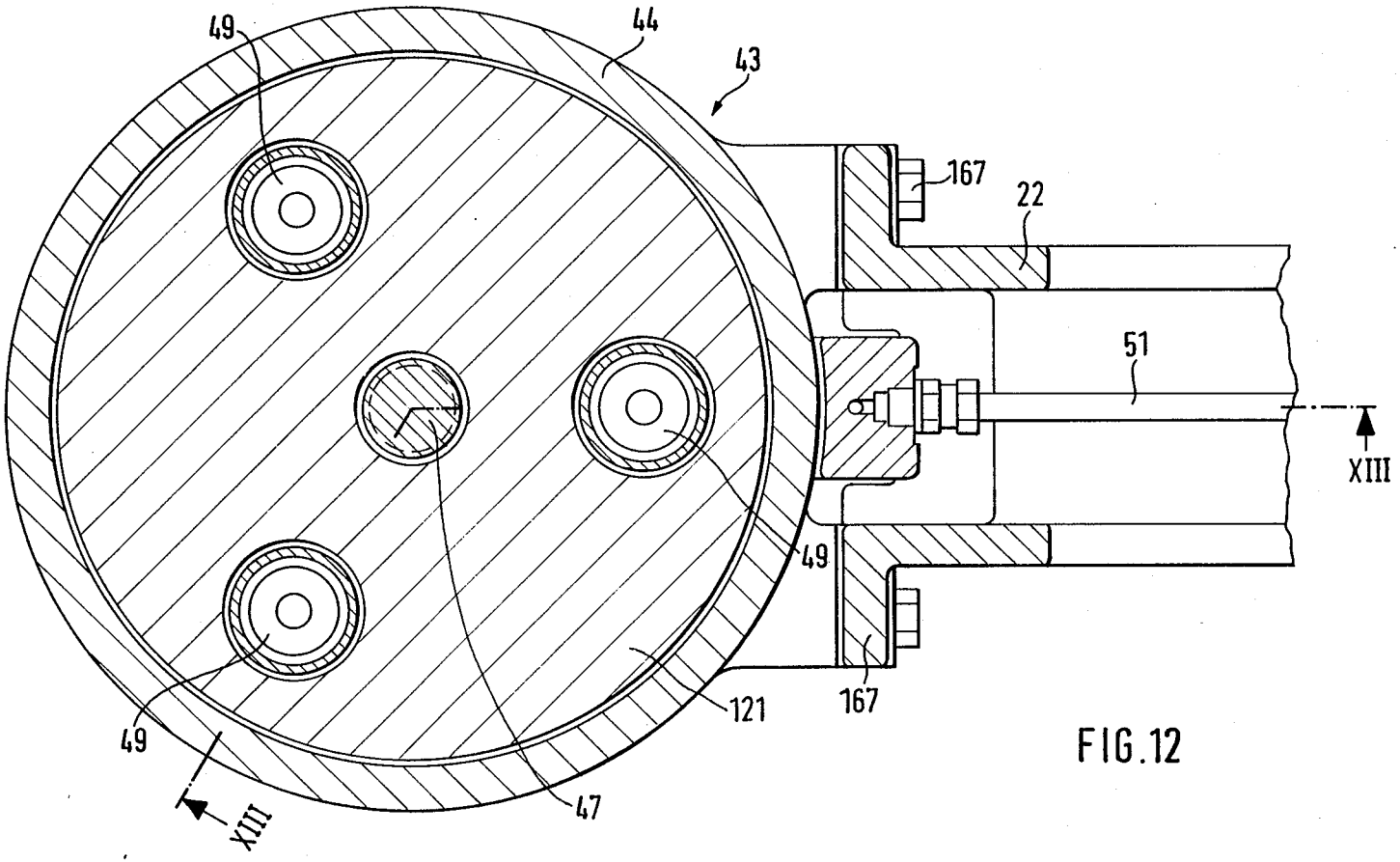
FIG. 12 is a cross section along line IX–IX in FIG. 11 of the drive head shown in FIG. 11.

An exceptionally simple and operationally reliable embodiment of a stopper drive head 43 according to the invention will be explained in greater detail with reference to FIGS. 11 and 12. The head again is mounted at the free end of the traverse 22 and comprises a pot-shaped frame or housing 44 and a support plate 120 arranged below the bottom 153 of the housing and likewise connected rigidly to the traverse 22. The stopper adjustment unit B is embodied by spring members 49 of the kind already described and adapted to be pressurized pneumatically, with the only exception that these spring members are of particularly long stroke, as will be described in greater detail below with reference to FIG. 13. These spring members 49, on the one hand, are supported on the support plate 120 and, on the other hand, on a mass 121 firmly connected to the stopper rod and presenting the stopper closing member A'. The weight of the mass 121 is some 50 to 80 kg, being dependent, in the final analysis, on the required stopper closing power. The stopper 15 is movable out of its closing position against the action of this weight. The spring members 49 are supported on the mass 121 in vertical blind bores 122 formed in the stopper closing mass 121.

The mass 121 is secured by nuts 103, 104 at the free upper end of the stopper rod 47, in a manner similar to the support member 102 of the embodiment shown in FIGS. 5 to 7. Compressed air is supplied to the spring members 49 through the compressed air conduit 51 and the compressed air connection 67 within the drive head 43. The frame or housing 44 is secured to the traverse 22 by fastening bolts 167.

Figure 13:
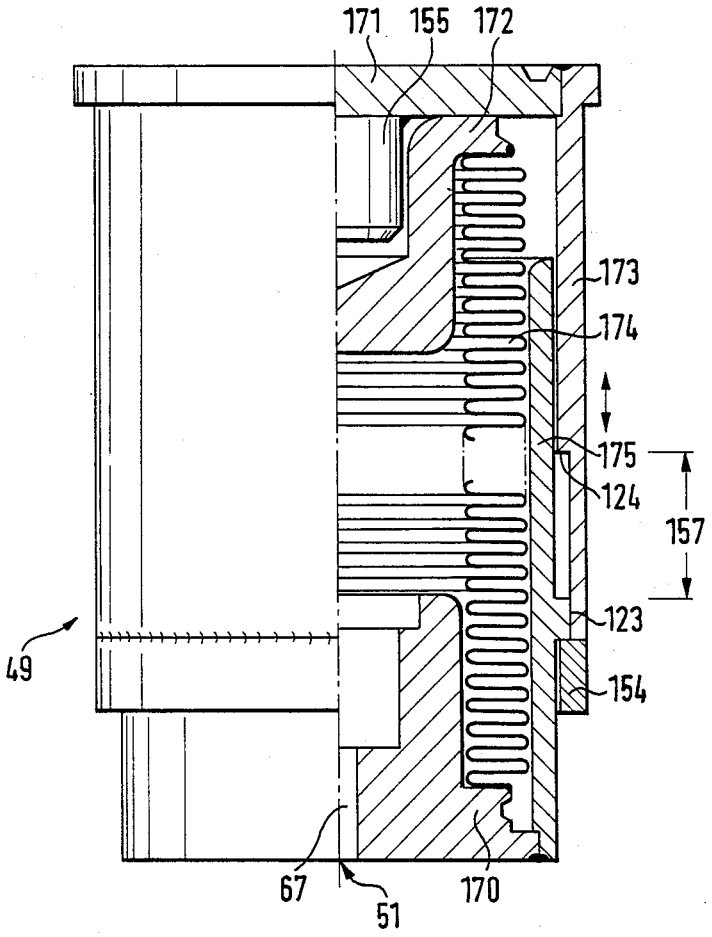
FIG. 13 is a sectional elevation of a particularly advantageous embodiment of a long stroke stopper adjustment member, on an enlarged scale, used for example with a drive head as shown in FIGS. 11 and 12.

The long-stroke spring members 49 according to FIGS. 11 and 12 now will be described with reference to FIG. 13. They are embodied by open gas pressure springs characterized by an upper support plate 171, a lower support plate 170, an upper metal bellows guide member 172, an outer housing 173 connected to the upper support plate, an inner housing 175 connected to the lower support plate 170, a metal bellows 174 connected at one end to the upper metal bellows guide member 172 and at the lower end to the lower support plate 170, and a stroke limiting ring 154 which is arranged at the lower free end of the outer housing 173 and cooperates with a radial projection 123 provided at the inner housing 175. The upper bellows guide member 172 is centered by a pin 155 which is provided at the inner side of the upper support plate 171 to which it is welded.

Pressurized air can be introduced through a connection 67 provided at the lower support plate 170 into the space defined by the metal bellows, on the one hand, and by the upper bellows guide member 172 and the lower support plate 170 on the other hand. The compressed air conduit 51 already described communicates with the connection 67. Compressed air is introduced in assembled condition, against the action of the stopper closing member A'. The gas pressure spring members 49 which are open through the compressed air connection 67 permit a stroke of up to 100 mm. When using such members, therefore, vertical displacement of the traverse 22 can be dispensed with. The zero position of the stopper 15 can be adjusted exclusively by corresponding pressurization of the open gas pressure springs 49. The stroke length mentioned is limited at one end by the radial projection 123 formed at the inner housing 175 and the stroke limiting ring 154 which is welded to the outer housing and, at the other end, by the same radial projection 123 and by an annular step 124 formed at the inside of the outer housing 173 at an axial spacing from the stroke limiting ring 154. The maximum stroke length of the open spring member 49 is indicated by reference numeral 157.

Figure 14:
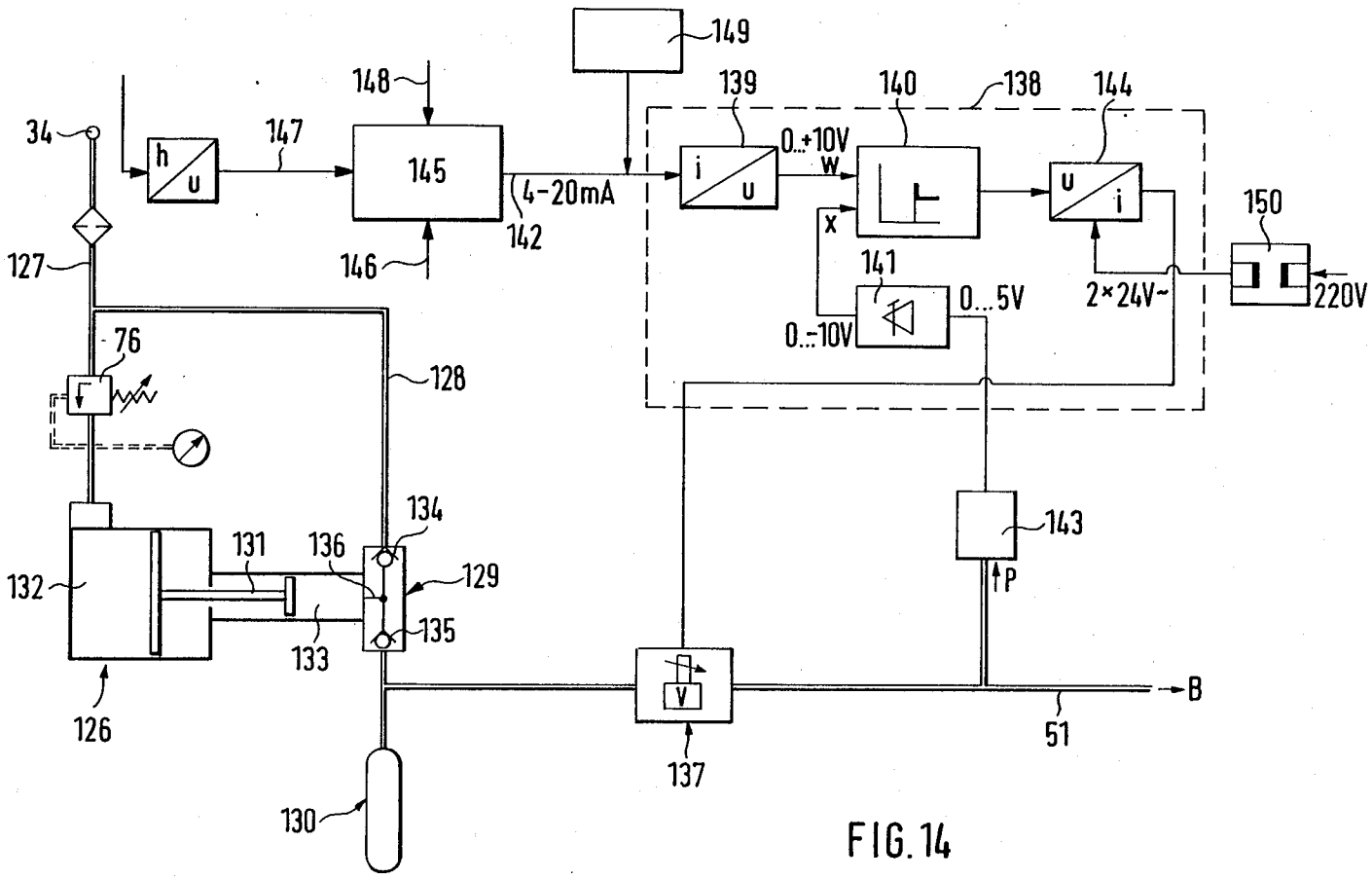
FIG. 14 shows a modified embodiment of the stopper control.

Another modified control system for the stopper movement will be described with reference to FIG. 14 showing an embodiment which continues to operate safely and reliably even if unnoticed leaks—even of more serious nature—should occur in the compressed air network of the stopper adjustment unit B. The starting point of this control system likewise is the pressure air source 34 of approximately 6 bar described with reference to FIG. 10 and practically available in any larger works, especially in foundries. This pressure air source is connected to the compressed air conduit 51 leading to the pneumatically operated stopper adjustment unit B by a so-called pressure increase or booster unit 126. The compressed air conduit leading from the pressure air source 34 to the pressure booster unit 126 is indicated by reference numeral 127. This is a kind of "low pressure line". A pressure relief valve 76 in accordance with FIG. 10 is arranged in this line as well. Upstream of the pressure relief valve a line 128 branches off to a double check valve associated, on the one hand, with the pressure booster unit 126 and, on the other hand, with a controlled pressure source 130. The compressed air conduit 51 already mentioned branches off from the connecting line between the double check valve 129 and the control pressure source 130. The pressure booster unit 126 comprises a differential piston 131, with a low pressure cylinder chamber 132 being associated with the portion of the piston 131 having the greater diameter and a high pressure cylinder chamber 133 being associated with the smaller diameter part of piston 131. The low pressure line 127 is connected to the low pressure cylinder chamber 132. The double check valve 129 is coordinated with the high pressure cylinder chamber 133 in a manner whereby a check valve 134 opening only in the direction of the high pressure cylinder chamber 133 is provided in the connection between branch line 128 and high pressure cylinder chamber 133, and a check valve 135 opening only in the direction of the compressed air conduit 51 is provided in the connection between the high pressure cylinder chamber 133 and the control pressure source 130 or the compressed air conduit 51 leading to the stopper adjustment unit B. The two check valves 134, 135 are combined in a structural unit of double check valve 129 such that the fluid connection between the two check valves 134 and 135 is linked by a tap line 136 to the high pressure cylinder chamber 133.

The pressure booster unit 126 operates in combination with the double check valve 129 in the manner of a pneumatic pump by which the control pressure source 130 can be charged so that the control pressure will amount, for instance, to 50 bar. The pressure booster unit 126 and double check valve 129 are adjusted in such manner that the control pressure in the control pressure source 130 will be kept approximately constant. This means that the control pressure source will be "recharged" immediately if any leaks should occur. With the conditions as described, an operating pressure of 6 bar prevails in the low pressure cylinder chamber 132, while a pressure of approximately 50 bar must be build up in the high pressure cylinder chamber 133. The resupply of air to the cylinder chamber 133 is effected through branch line 128 and check valve 134.

A servo valve 137 which communicates with an electronic unit 138 is provided in compressed air conduit 51. This electronic unit consists of a current-voltage transducer 139, a PID controller 140, and a measuring amplifier 141. The rated value signal 142 to be applied to the electronic unit 138 thus is converted into a proportional voltage signal. In the PID controller 140 the actual value of the pressure prevailing in conduit 51 likewise is taken into consideration. This pressure is determined by a pressure pickup 143 connected downstream of the servo valve 137. The actual pressure value signal is applied through the measuring value amplifier 141 to the PID controller 140 which is followed by a voltage-current transducer 144 supplying signals for switching the servo valve 137.

The actual value signal 142 to be applied is generated and supplied by a signal processor 145 connected upstream of the electronic unit 138, furnishing the signal in consideration of the rated value 146 of the melt level which is supplied by the process controller 96, (not shown in FIG. 14), the actual value 147 of the melt level, and a signal 148 indicating the stopper travelling distance. The signal 148 is furnished by a temperature insensitive motion pickup, especially a capacitive displacement pickup associated with the stopper 15 or the stopper rod 47.

A hand control signal may be superimposed over the rated value signal 142. It is likewise possible to mix-in the signal "stopper: emergency OPEN" or "stopper: emergency CLOSE". This switching-in is effected by an integrator 149 associated with the signal line 142.

A mains transformer 150 is connected between the electronic unit 138 and mains.

At this point it should also be mentioned that the open spring members 49 of the stopper adjustment unit B may be pressurized hydraulically as well. In this event, however, the drive head 43 must be cooled under any circumstances in order to avoid any formation of vapor within the hydraulic conduits. It is likewise conceivable to cool the hydraulic medium by circulation. The members 49 in this case preferably are embodied by piston and cylinder units adapted to be pressurized at one end.

The pressure generator 50 according to FIG. 10 may be replaced by a so-called hydro-bubble reservoir including a hydraulic chamber which is connected to the hydraulic end, i.e. conduit 84 and a pneumatic chamber (gas bubble) which is connected to the pneumatic end, i.e. conduits 53, 51. In that event preferably a flow rate meter is arranged in the hydraulic conduit 84 to replace the displacement pickup 89 of the embodiment shown in FIG. 10.

Figure 15:
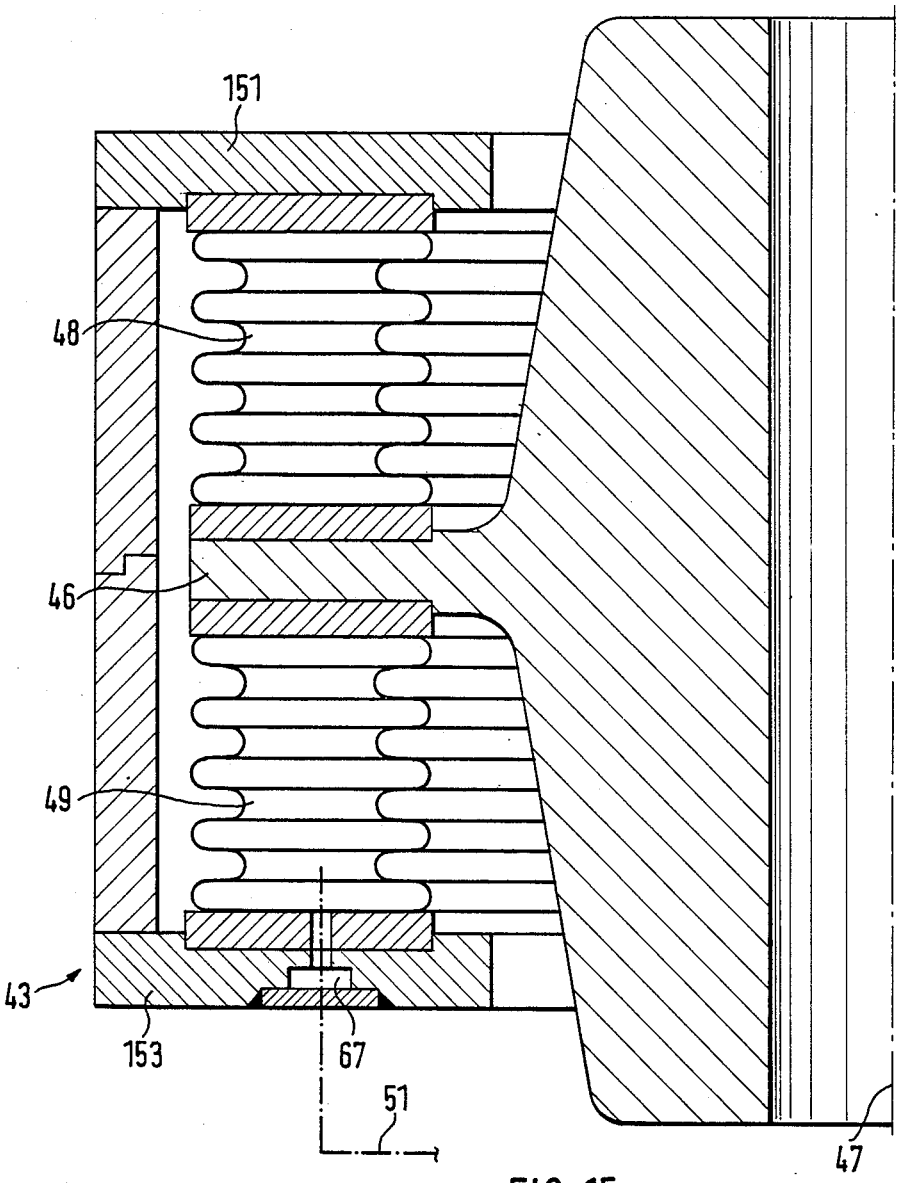
FIG. 15 is a sixth embodiment of a drive stopper drive head.

An embodiment of the stopper drive head 43 especially advantageous regarding the reduction of a possibly occurring hysteresis between control pressure in the pressure conduit 51 leading to the connection 67 and the actual path of movement will be described in FIG. 15. Model tests have shown that the mentioned hysteresis is less when the pressure variations are smaller. Accordingly, it is suggested as shown in FIG. 15, to construct as large as possible the acting surface acting in the direction "stopper OPEN". Concretely, as well the element 48 urging the stopper into the closing position as also the stopper adjusting element 49 are formed as ring bellow elements extending around the stopper rod 47, the said element 48 is filled with gas, especially air and is closed, while the element 49 is controllable via the pressure means connection 67—as described above.

Instead of the bellow element 48, also a constant mass can serve as stopper reset element. Mechanical spring elements are also conceivable. In principle, the stopper reset member can be so constructed as described above by means of the other embodiments. Accordingly, it is also possible to provide the bellow element 48 in an open form; in this case a fluid connection between the two elements 48, 49 is provided in which a 5/3 way proportional valve is arranged. Insofar, thus only little limits are set to the construction.

The enlarged acting surface in the area of the adjusting member 49 has also the advantage that one can operate with a smaller control pressure. Further, the adjusting force can be distributed evenly over the dimension of the drive head 43, so that other balancing means, like expensive guides may be omitted.

All the features disclosed in the application documents are claimed as essential of the invention in as much as they are novel as compared to the state of the art, either individually or in combination.

What is claimed is:

1. An apparatus for controlled adjustment of a stopper in a distributor channel or metallurgical vessel of a continuous casting plant comprising:

a transom or traverse disposed above the distributor channel or the metallurgical vessel connected to the stopper;

a guide member fixed to a side of the distributor channel or metallurgical vessel;

a rod that is vertically displaceable in the guide member, the traverse being connected to the rod;

a stopper drive head arranged between the transom or traverse and the stopper, said stopper drive head comprising an elastic stopper closing member which increasingly urges the stopper into closing position in correspondence with rising temperature and a stopper adjustment unit which is effective against the action of said member and is operable pneumatically.

2. The apparatus as claimed in claim 1, wherein the stopper closing member is embodied by at least one closed gas pressure spring, while one or more open spring members serve as the adjustment unit which members are adapted to be pressurized pneumatically, in common or individually, against the action of the closed spring member or members.

3. The apparatus as claimed in claim 2, wherein a pressure generator is associated with the open spring members and forms an hydropenumatic transforming unit, the hydraulic end being in fluid communication with a pressure or volume flow proportional valve and the pneumatic end being in fluid communication with both a pressure gas source and the open spring members defining the adjustment unit.

4. The apparatus as claimed in claim 3, wherein there is provided a conduit between the pressure gas source and the pneumatic end of the pressure generator, a pressure relief valve and a check valve adapted to be opened only in the direction of the pneumatic end of the pressure generator being arranged in the conduit.

5. The apparatus as claimed in claim 3, wherein a gallows is provided which carries the stopper drive head with the stopper, said gallows having a locking means which, through a changeover valve, is in fluid communication with the pressure gas source.

6. The apparatus as claimed in claim 3, wherein a displacement pickup is associated with the piston of the transforming pressure generator for feedback of the piston movement to the proportional valve associated with the hydraulic drive end and for comparison of the piston movement with the stopper movement, the displacement pickup supplying traveling distance signals which are comparable for this purpose in a signal processor with the actual stopper movements derived from the pressure and temperature at the adjustment unit or elastic member, respectively.

7. The apparatus as claimed in claim 1, wherein the stopper closing member is formed by a plurality of spring members arranged in a plane approximately vertically to the longitudinal axis of the stopper, and around the same, at approximately equal spacing from one another, while likewise a plurality of adjustment members which are operative like a piston and cylinder unit serve as the stopper adjustment unit, said adjustment members each being arranged between the spring members constituting the stopper closing member and adapted to be pressurized pneumatically, in common or individually, against the action of the spring members constituting the stopper closing member.

8. The apparatus as claimed in claim 7, wherein the spring members forming the stopper closing member are closed gas pressure springs of increasing rigidity at increasing temperature or high temperature resistant Belleville springs of constant rigidity which are substantially independent of the temperature, the spring members forming the stopper closing members permitting a stopper stroke length of at least 50 to 100 mm, with a stransom or traverse which is fixed in vertical direction.

9. The apparatus as set forth in claim 2 wherein the spring members forming the stopper closing members permit a stopper stroke length of approximately 70 mm.

10. The apparatus, as claimed in claim 7, wherein the stopper adjustment members of the type of a piston and cylinder unit, constituting the stopper adjustment unit, are spring members adapted to be pressurized at an end associated with a pneumatic control pressure source, said pneumatic control pressure source being adapted to be opened by a servo valve with corresponding spontaneous pressurization of the spring members, control of the servo valve being effected in consideration of: the desired melt level value; the actual melt level value; and the stopper position as determined from the signal of a motion pickup associated with the stopper or stopper rod.

11. The apparatus as claimed in claim 10, wherein the control pressure source is connected, through a pressure raising unit, to a pneumatic low pressure source by which the pneumatic control pressure source is maintained at approximately a consistent high pressure level, preferably of about 50 bar.

12. The apparatus as set forth in claim 10 wherein the control of the servo valve is also effected in consideration of the temperature prevailing at the drive head.

13. The method as set forth in claim 12 wherein the traveling distance meter is a pneumatic traveling distance meter.

14. The apparatus as claimed in claim 1, wherein a mechanical locking means adapted to be operated pneumatically is associated with the vertically displaceable rod to which the traverse is connected that carries the stopper drive head with the stopper.

15. The apparatus as claimed in claim 1, wherein a thermocouple is associated with the elastic member or the closed spring members defining the same to determine the temperature prevailing there, said thermocouple being operatively connected with a signal processor so that the closing power of the closed spring members can be calculated from the temperature determined, against which closing power the adjustment unit is controllable, with corresponding up or down movement of the stopper.

16. The apparatus as claimed in claim 1, wherein the stopper drive head comprises a passage, through which a coolant flows, forming a cooling jacket around the stopper closing members and stopper adjustment units.

17. The apparatus as claimed in claim 1, wherein the stopper closing member is formed by three spring members arranged in a plane approximately vertically to the longitudinal axis of the stopper, around the same, at approximately equal spacing from one another, while likewise three adjustment members which are operative like piston and cylinder units serve as the stopper adjustment unit, each of said members being arranged between the spring members constituting the stopper closing member and adapted to be pressurized pneumatically, in common or individually, against the action of the spring members constituting the stopper closing member.

18. The apparatus at claimed in claim 1, wherein the stopper closing member is formed by a spring emmber arranged in a plane approximately vertically to the longitudinal axis of the stopper, while likewise an adjustment member which is operative like a piston and cylinder unit serves as the stopper adjustment unit, said adjustment member being adapted to be pressurized pneumatically against the action of the spring member constituting the stopper closing member.

19. The apparatus as claimed in claim 18, wherein the spring member forming the stopper closing member is a closed gas pressure spring of increasing rigidity at increasing temperature or a high temperature resistant Belleville spring of constant rigidity which is substantially independent of the temperature, the spring member forming the stopper closing member permitting a stopper stroke length of at least 50 to 100 mm, with a transom or traverse which is fixed in vertical direction.

20. An apparatus for controlled adjustment of a stopper in a distributor channel or metallurgical vessel of a continuous casting plant, comprising:

a transom or traverse being connected to the stopper and disposed above the distributor channel or the metallurgical vessel; and a stopper drive head being arranged between the transom or traverse and the stopper to be directly above the distributor channel and comprising a stopper closing member which urges the stopper into closing position at approximately constant force substantially independently of the temperature and a stopper adjustment unit which is effective against the action of said member and is operable pneumatically.

21. The apparatus as claimed in claim 20, wherein a constant mass series as the stopper closing member, at least one stopper adjustment member, each of which is operative like a piston and cylinder unit, being effective against said mass, said at least one adjustment member being supported at the stoper closing mass preferably within vertical bores formed in the stopper closing mass.

22. The apparatus, as claimed in claim 21, wherein the stopper adjustment members of the type of a piston and cylinder unit, constituting the stopper adjustment unit, are spring members adapted to be pressurized at an end associated wit a pneumatic control pressure source, said pneumatic control pressure source being adapted to be opened by a servo valve with corresponding spontaneous pressurization of the spring members, control of the servo valve being effected in consideration of: the desired melt level value; the actual melt level value; and the stopper position as determined from the signal of a motion pickup associated with the stopper or stopper rod.

23. The apparatus as set forth in claim 22, wherein the control pressure source is connected, through a pressure raising unit, to a pneumatic low pressure source by which the pneumatic control pressure source is maintained at approximately a consistent high pressure level, preferably of about 50 bar.

24. The apparatus as set forth in claim 22 wherein the control of the servo valve is also effected in consideration of the temperature prevailing at the drive head.

25. The apparatus as claimed in claim 20, wherein a constant mass servies as the stopper closing member against which mass three stopper adjustment members which are operative like a piston and cylinder unit are effective, said adjustment members being supported at the stopper closing mass preferably within vertical bores formed in the stopper closing mass.

26. The apparatus as claimed in claim 20, wherein the stopper drive head comprises a passage, through which a coolant flows, forming a cooling jacket around the stopper closing members and stopper adjustment units.

27. A method of automatically filling a continuous casting mold with steel melt comprising:

providing a metallurgical vessel with a supply of steel melt, said metallurgical vessel defining a bottom hole in fluid communication with the continuous casting mold;

urging a stopper, which is capable of predetermined up and down movement, into said bottom hole with an elastic member positioned directly above the steel melt, said elastic member being operable pneumatically and urging the stopper with a force which increases in magnitude as the temperature of the steel melt increases;

monitoring the level of the steel melt in the continuous casting mold; and controlling the up and down movement of the stopper with an adjustment unit which is operable pneumatically, is positioned above the steel melt, and which acts directly at the top end of the stopper to exert an adjustable force in opposition to the force urging the stopper into the bottom hole of the metallurgical vessel in response to the monitored level of the steel melt in the continuous casting mold.

28. The method as set forth in claim 27 further comprising the step of:

oscillating the stopper around its longitudinal axis when it is in the open position, this oscillating movement being adapted to be superimposed over the up and down movement of the stopper.

29. The method as set forth in claim 27 further comprising the step of:

oscillating the stopper in the direction of its up and down movement and around its longitudinal axis when it is in the open position, this oscillating movement being adapted to be superimposed over the up and down movement of the stopper.

30. The method as set forth in 27 wherein the traveling distance and position of the stopper are determined directly by a traveling distance meter directly associated with the stopper.

31. The method as set forth in claim 30 wherein the traveling distance meter is a laser traveling distance meter.

32. The method as set forth in claim 27, further comprising the steps of:

determining the temperature at the elastic member; and controlling the elastic member to urge the stopper in response to the determined temperature thereby allowing the closing power of the elastic member to be derived from the same by calculation.

33. The method as set forth in claim 27 further comprising the step of:

oscillating the stopper in the direction of its up and down movement when it is in the open position, this oscillating movement being adapted to be superimposed over the up and down movement of the stopper.

34. The method as set forth in claim 27 wherein the traveling distance and position of the stopper are determined indirectly by the force or pressure exerted on the elastic member.

35. The method as set forth in claim 27 wherein the hardness or spring characteristic of the elastic member acting in closing direction of the stopper is variable.

36. A method of automatically filling a continuous casting mold with steel melt comprising:

providing a metallurgical vessel with a supply of steel melt, said metallurgical vessel defining a bottom hole in fluid communication with the continuous casting mold;

urging a stopper, which is capable of predetermined up and down movements, into said bottom hole with a constant force;

monitoring the level of the steel melt in the continuous casting mold; and controlling the up and down movement of the stopper with an adjustment unit which is operable pneumatically and acts directly at the top end of the stopper to exert an adjustable force acting in opposition to the force urging the stopper in the bottom hole of the metallurgical vessel in response the monitored level of the steel melt in the continuous casting mold.

37. An apparatus for controlled adjustment of a stopper in a distributor channel or metallurgical vessel of a continuous casting plant comprising;

a transom or traverse disposed above the distributor channel or the metallurgical vessel connected to the stopper;

a guide member fixed to a side of the distributor channel or metallurgical vessel;

a rod that is vertically displaceable in the guide member, the transom or traverse being connected to the rod;

a stopper drive head being arranged between the traverse and the stopper, said stopper drive head comprising an elastic stopper closing member made up of at least one pneumatically operated open gas pressure spring which urges the stopper into closing position and a stopper adjustment unit which is effective against the action of said stopper closing member and is made up of at least one open gas pressure spring which is adapted to be pressurized pneumatically, in common or individually, against the action of the at least one open gas pressure spring of the stopper closing member.

* * * * *